US005316505A

United States Patent [19]

Kipp

[11] Patent Number: 5,316,505

[45] Date of Patent: May 31, 1994

[54] STAMPED BATTERY TERMINAL CONNECTOR

[75] Inventor: LeRoy E. Kipp, Port Huron, Mich.

[73] Assignee: Prestolite Wire Corporation, Farmington Hills, Mich.

[21] Appl. No.: 923,145

[22] Filed: Jul. 31, 1992

[51] Int. Cl.[5] ..... H01R 4/42

[52] U.S. Cl. ..... 439/762; 439/764

[58] Field of Search ..... 439/761, 762, 764–766, 439/756, 759

[56] References Cited

U.S. PATENT DOCUMENTS

| | | | |
|---|---|---|---|
| 2,068,452 | 1/1937 | Hansen . | |
| 2,222,577 | 11/1940 | Thompson . | |
| 3,568,138 | 3/1971 | Bakker . | |
| 4,054,355 | 10/1977 | Kourimsky et al. . | |
| 4,063,794 | 12/1977 | Dittmann . | |
| 4,354,726 | 10/1982 | Kato et al. . | |
| 5,087,214 | 2/1992 | Dewar | 439/762 |

*Primary Examiner*—Paula A. Bradley
*Attorney, Agent, or Firm*—Remy J. VanOphem

[57] ABSTRACT

A battery terminal connector which is capable of reliably maintaining an electrical cable or harness in electrical contact with a battery, while having the added benefit of having an economical two-piece construction whose individual members are formed by separate stamping operations. The two-piece construction permits one member to be sized and structured to securely clamp the battery terminal post while the second member is sized and structured to securely crimp the electrical cable or cables. The battery terminal connector includes two separate circumferential bands, each of which circumscribes and clamps the battery terminal post. The circumferential bands define a circumferential slot therebetween which slightly extrudes the battery terminal post to increase the retention capability of the battery terminal connector.

21 Claims, 2 Drawing Sheets

STAMPED BATTERY TERMINAL CONNECTOR

BACKGROUND OF THE INVENTION

1. Field of the Invention

The present invention generally relates to battery terminal connectors which are employed to connect a wire harness or electrical cable to a battery in automotive and marine applications. More specifically, this invention pertains to a two-piece stamped battery terminal connector whose construction provides improved retention of the connector to the battery post while also permitting repeated use without significant loss in structural integrity.

2. Description of the Prior Art

Electrical harnesses and battery cables used in automotive and marine applications are typically attached to the terminal post of a lead-acid storage battery with some form of battery terminal connector. To ensure that a reliable electrical contact is maintained, the battery terminal connector must be constructed such that it will remain securely attached to the terminal post of the battery even when subjected to road vibrations and various other adverse conditions. At the same time, the battery terminal connector must almost permit the battery cable to be easily disconnected and reconnected from the battery to facilitate the removal or replacement of the battery. As a result, the structural criteria for battery terminal connectors includes the retention strength of the connector, the ease with which the connector can be attached to and detached from the battery, and the ability to be reused numerous times without a significant loss in the structural integrity of the connector.

Conventionally, a battery terminal connector is attached to one of two battery terminal posts which are formed from a lead alloy. Typically, the terminal post has the shape of an inverted frustum of a cone, which facilitates the ease by which the connector can be mounted to and removed from the terminal post. The most common form for a battery terminal connector is a die cast lead split collar design. The collar includes a yoke formed at the split to form a slot therebetween. The split collar construction enables the connector to be expanded and easily slipped over the battery terminal post. Thereafter the slot is collapsed, generally with a bolt and nut combination mounted to the yoke, to reduce the diameter of the collar and thereby frictionally secure the connector to the battery post.

However, the smooth tapered shape of the terminal post does not provide an ideal attachment site for the connector. In particular, the shape of the terminal post naturally urges the connector upward and off the terminal post when subjected to vibration or accidental impact. This condition is further exasperated by the use of petroleum jelly or other lubricants which are often applied to the terminal post to reduce the buildup of chemical deposits on the terminal post and connector. As a result, a very high clamping force is necessary to provide reliable attachment of the connector to the terminal post.

However, conventional connectors have a smooth and equally-tapered interior surface by which contact is made with the terminal post. As a consequence, the clamping pressure of the connector is reduced because it is distributed over the relatively large and uninterrupted surface of the terminal post. Such connectors must therefore be designed to have sufficient structural strength to impart higher clamping forces on the terminal post than would be required if either the connector or the terminal post were provided with an irregular surface feature.

To reduce the level of clamping loads necessary to retain the connector on the terminal post, it has been suggested in the prior art to provide longitudinal serrations or the like about the circumference of the connector. Examples include U.S. Pat. No. 2,068,452 to Hansen, U.S. Pat. No. 4,063,794 to Dittmann, and U.S. Pat. No. 4,354,726 to Kato et al. While such an approach does improve the clamping pressure of the connector relative to its available clamping load by reducing the connector's contact area, the slight twisting action often necessary to remove a connector from the terminal post will severely damage the soft lead material from which the terminal post is made.

Even when a connector is adequate in terms of gripping power, repeated detaching and reattaching of the connector causes work hardening and plastic deformation of the material, thereby making it more difficult to sufficiently clamp the connector onto the post to get an adequate electrical connection. Consequently, as the clamping force of the connector is reduced, it becomes prone to being vibrated or accidently dislodged from the battery post. In automotive and marine applications, the resulting loss of electrical power to the vehicle's accessories, such as headlamps and control systems, can be extremely hazardous.

While die cast lead connectors are more common, one-piece battery terminal connectors formed from sheet metal have been suggested by the prior art due to the manufacturing advantages associated with shearing, stamping and bending operations, such as lower costs and reduced waste and scrappage. Examples of stamped connectors known in the prior art are taught by U.S. Pat. No. 2,222,577 to Thompson, U.S. Pat. No. 3,568,138 to Bakker et al., and U.S. Pat. No. 4,054,355 to Kourimsky et al. While each of the approaches taught by the above prior art provides manufacturing benefits, each is generally limited in terms of the clamping force it can generate and/or its structural strength. Because of the substantially unreinforced framework formed during the bending operation, the connectors of both Thompson and Bakker are highly susceptible to plastic deformation and buckling of the connector under high clamping loads, particularly at the point where the fastener passes through the connector. The connector taught by Kourimsky is susceptible to plastic elongation of the clamping arms because, with three clamping bands and the limited length of the terminal post, the widths of the bands are severely limited. Moreover, the connector taught by Bakker is highly susceptible to work hardening and fracture of the connector material from repeated use because the connector's arms are flexed in the plane corresponding to their widest dimensions, which intensifies the elongation and compression at the connector's radially outer-and inner-most extremities, respectively. Accordingly, the stamped battery terminal connectors of the prior art do not provide adequate strength and structural durability to survive the repeated use and abuse often encountered in automotive and marine applications.

From the above discussion, it can be readily appreciated that the prior art does not disclose a battery terminal connector which has the cost advantages of being formed by a stamping operation while also providing the structural and clamping strength necessary to survive repeated use in an automotive or marine environment.

Accordingly, what is needed is a low-cost battery terminal connector which can be formed by a stamping operation, while being capable of providing sufficient structural strength and flexibility to permit repeated attachment and detachment. In addition, such a terminal connector should also possess the ability to generate a clamping force which will securely retain the connector on the battery terminal post without damaging the terminal post.

SUMMARY OF THE INVENTION

According to the present invention there is provided a stamped battery terminal connector whose structure is capable of producing a clamping force upon a battery terminal post which will reliably retain the connector on the terminal post without unnecessarily damaging the terminal post when the connector is being removed. The structure of the connector permits the use of a relatively low cost manufacturing process, yet the resulting structure is sufficiently durable to permit repeated use without excessive plastic deformation of the connector. In addition, the connector employs a pair of coacting clamping bands which improve the retention capability of the connector without excessive distortion of the terminal post. Finally, the connector is a two-piece construction which makes the connector more versatile in terms of being adaptable to the particular orientation of the battery within its compartment. The two-piece construction is also economically advantageous in that each piece can be manufactured in assorted sizes to enable the connector to be assembled to fit different size combinations of electrical cables and battery terminal posts, instead of requiring that the entire connector be sized to fit all possible size combinations of cables and posts.

As is conventional, the battery terminal connector of the present invention is intended to electrically connect an electrical cable or harness to a battery having a pair of lead terminal posts. The connector includes a crimping feature for gripping the electrical cable and a terminal connector for gripping the battery terminal post. Each feature is provided by a separately stamped member, and the stamped members are fastened together to form a battery terminal connector assembly. Because the stamped members are separately formed, each can be specifically adapted for their intended purpose, either to grip the electrical cable or grip the battery terminal post. In addition, by fastening the stamped members together in a manner that enables them to be easily disassembled from each other, the electrical cable can be disconnected from the terminal post without detaching the terminal connector from the terminal post.

The stamped member serving as the terminal connector includes a gripping portion having a substantially tubular shape so as to have an axial opening therethrough. More particularly, the axial opening has an inverted frustoconical shape corresponding to that of the terminal post. The gripping portion has a pair of coaxial circumferential members which define the tubular shape of the gripping portion. The circumferential members are spaced apart so as to define a circumferential slot therebetween. Because the axial opening has an inverted frustoconical shape, the upper circumferential member will have a nominally smaller internal diameter than the lower circumferential member. The terminal connector also includes a flange portion which extends from the gripping portion. The flange portion joins the upper and lower circumferential members to unite the terminal connector portion. Associated with the flange portion is a device or mechanism for constricting the upper and lower circumferential members, such as a threaded bolt and nut assembly.

According to a preferred aspect of this invention, operation of the constricting mechanism causes a clamping action to be generated by both circumferential members on the terminal post. Because the circumferential members are separated by a circumferential slot and are joined only along a limited section of the terminal connector, each imparts a separate clamping force on the terminal post. In that the circumferential members are formed by a stamping operation and can be formed from a higher strength material such as brass instead of die cast lead, the circumferential members can be made relatively thin and narrow while still possessing sufficient strength to sustain the necessary clamping load on the terminal post. Accordingly, the circumferential members are well adapted to be flexed repeatedly without significant work hardening or plastic deformation.

In addition, the circumferential slot permits the terminal blade to slightly extrude between the circumferential members, creating a protrusion which improves the retention strength of the connector. Because the circumferential bands are relatively thin as formed by the stamping operation, they are readily expandable such that they can be opened sufficiently to permit the removal of the terminal connector without damage to the terminal post. In addition, the two-piece construction of the connector permits the electrical cable to be electrically disconnected from the battery by separating the two stamped members of the connector assembly. As a result, the lower circumferential band need not be forced over the protrusion when merely trying to electrically disconnect the electrical cable from the battery.

Another significant advantage of the present invention is that the flange portion is structured to be highly resistant to excessive clamping loads generated by the constricting device. In the preferred embodiment, the flange portion consists of a pair of parallel flanges having a limited gap therebetween. The gap limits the degree to which the flanges can be deflected toward each other and the degree to which the circumferential members can be constricted, such that the possibility of plastically deforming the flanges and the circumferential bands is practically eliminated. In addition, the flat profile of the flanges inherently is able to readily withstand a high compression force normal to the plane of the flanges, even when inadvertently imposed by overtightening the constricting mechanism.

Finally, each piece of the connector is made by a stamping operation, providing manufacturing advantages such as lower costs and reduced waste and scrappage. In that the crimping feature and the terminal connector are formed on separate stamped members, design flexibility is possible because the crimping feature and the gripping portion can both be mass-produced separately in various sizes and later paired to properly match different-sized electrical cables with different-sized terminal posts. By specifically sizing the terminal connector with the terminal post, the degree to which the terminal connector must be constricted to sufficiently clamp the terminal post is reduced, thereby diminishing the possibility that the terminal connector will be overstressed, work hardened or plastically deformed.

Accordingly, it is an object of the present invention to provide a battery terminal connector which is capable of reliably maintaining an electrical cable or harness in electrical contact with a battery.

It is a further object of the invention that the battery terminal connector be formed by a stamping operation so as to be economical to manufacture while also providing structural integrity to permit high clamping loads and repeated use.

It is still a further object of the invention that the battery terminal connector be a two-piece design, with one piece being dedicated to clamping the battery terminal post while the second piece is dedicated to crimping the electrical cable.

It is another object of the invention that the battery terminal connector include a gripping portion having two separate circumferential members for circumscribing and imposing two distinct clamping loads on the battery terminal post.

It is yet another object of the invention that the circumferential members define a circumferential slot therebetween which slightly extrudes the terminal post to increase the retention capability of the battery terminal connector.

It is still another object of the invention that the battery terminal connector be constructed to permit a limited degree of deflection so as to be substantially insusceptible to structural failure and plastic deformation.

Other objects and advantages of this invention will be more apparent after a reading of the following detailed description taken in conjunction with the drawings provided.

DETAILED DESCRIPTION OF THE PREFERRED EMBODIMENT

Figure 1:
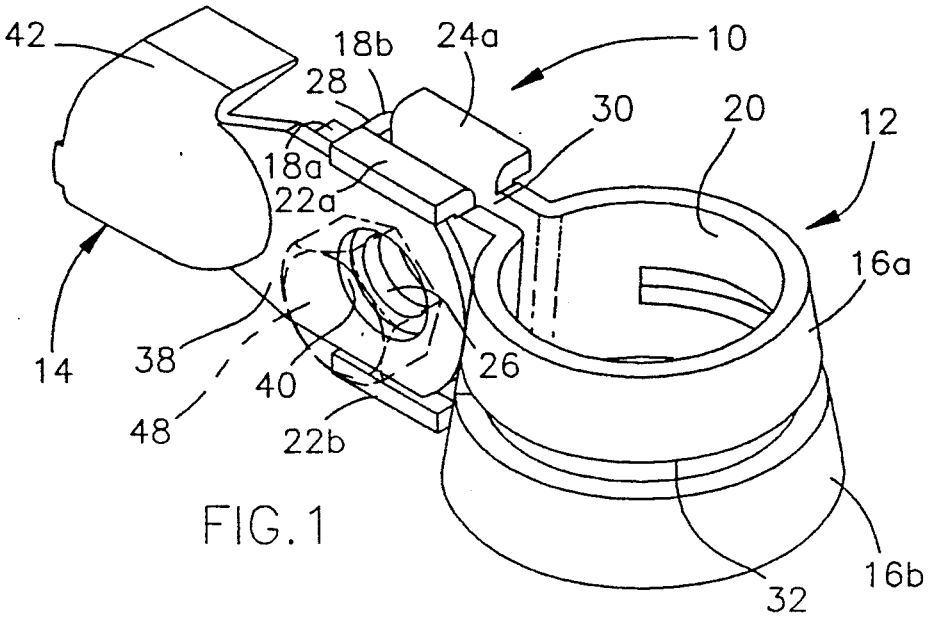
FIG. 1 is a perspective view of a battery terminal connector assembly in accordance with the preferred embodiment of this invention.
Figure 2:
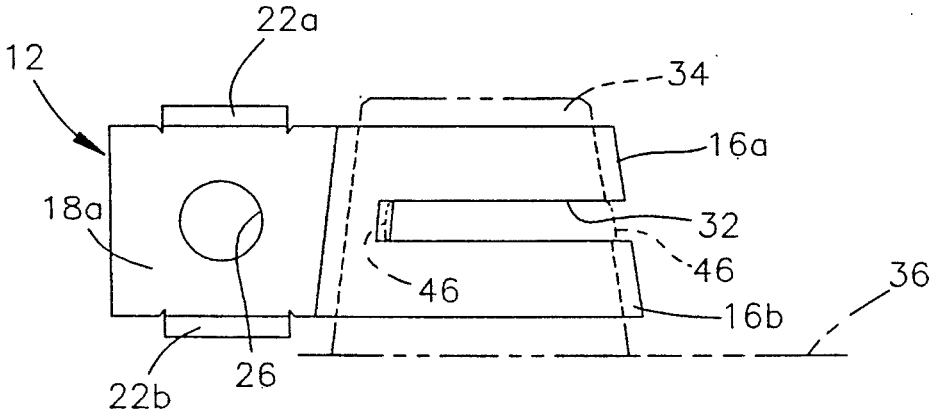
FIG. 2 is a side view of the main terminal of the assembly of FIG. 1 in accordance with the preferred embodiment of this invention.

With reference to FIGS. 1 and 2, there is shown a battery terminal connector assembly 10. As illustrated, the battery terminal connector assembly 10 is conventional to the extent that it is adapted to electrically connect an electrical cable or harness (not shown) to a battery 36 having a pair of lead terminal posts 34. The battery terminal connector assembly 10 includes a crimping ferrule for gripping the electrical cable and a terminal connector member for gripping the battery terminal post 34. The crimping ferrule is formed on a blade terminal 14 while the terminal connector member is formed by a main terminal 12. The main terminal 12 and blade terminal 14 are formed during separate stamping operations and then joined with a suitable fastener 48 (shown in phantom in FIG. 1) to form the battery terminal connector assembly 10.

Because the main terminal 12 and the blade terminal 14 are formed by separate stamping operations, they are each uniquely formed to perform their particular function. Specifically, the main terminal 12 is formed and sized to create a strong retention force between the battery terminal connector assembly 10 and the terminal post 34, while the blade terminal 14 is particularly adapted and sized to receive and retain an electrical cable or cables. Simultaneously, the main terminal 12 and blade terminal 14 are specially adapted to serve as a unitary assembly which can be readily disassembled. Specifically, the main terminal 12 includes a pair of lateral flanges 18*a* and 18*b* which extend parallel in spaced-apart relation from the main terminal 12. Extending in opposite directions from the lateral flanges 18*a* and 18*b* are pairs of flanges 22*a* and 22*b*, and 24*a* and 24*b*, respectively. The blade terminal 14 is received between one of the pairs of flanges 22*a*, 22*b* or 24*a*, 24*b* as shown in FIG. 1. Primarily the flanges 22*a*, 22*b* and 24*a*, 24*b* prevent the rotation of a nut (not shown) used to retain the fastener 48 to ease the assembly of the battery terminal connector assembly 10. The blade terminal 14 lies flat against one of the lateral flanges 18*a* and 18*b*, thereby practically eliminating the possibility that the blade terminal 14 or the lateral flanges 18*a* and 18*b* will be plastically deformed or structurally fail if the fastener 48 is over-tightened.

Figure 3:
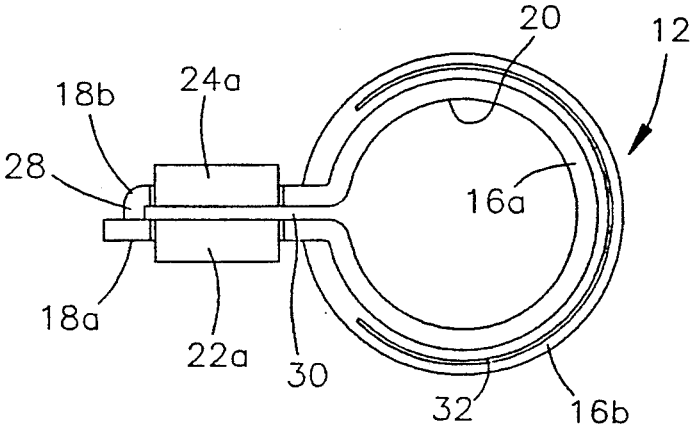
FIG. 3 is a plan view of the main terminal of FIG. 2 in accordance with the preferred embodiment of this invention.

As best seen in FIGS. 2 and 3, the main terminal 12 generally includes a tubular portion and the lateral flanges 18*a* and 18*b* noted above. The tubular portion has an axial opening 20 therethrough which preferably has an inverted frustoconical shape corresponding to the conventional shape of the battery terminal post 34. Because the main terminal 12 is stamped, the entire tubular portion preferably has a frustoconical shape as shown in FIGS. 1 through 3. The axial opening 20 of the main terminal 12 is defined by a pair of circumferential bands 16*a* and 16*b* which are joined together adjacent the lateral flanges 18*a* and 18*b*. The circumferential bands 16*a* and 16*b* define a circumferential slot 32 therebetween and, together, delineate the frustoconical shape of the tubular portion and the axial opening 20.

Figure 4:
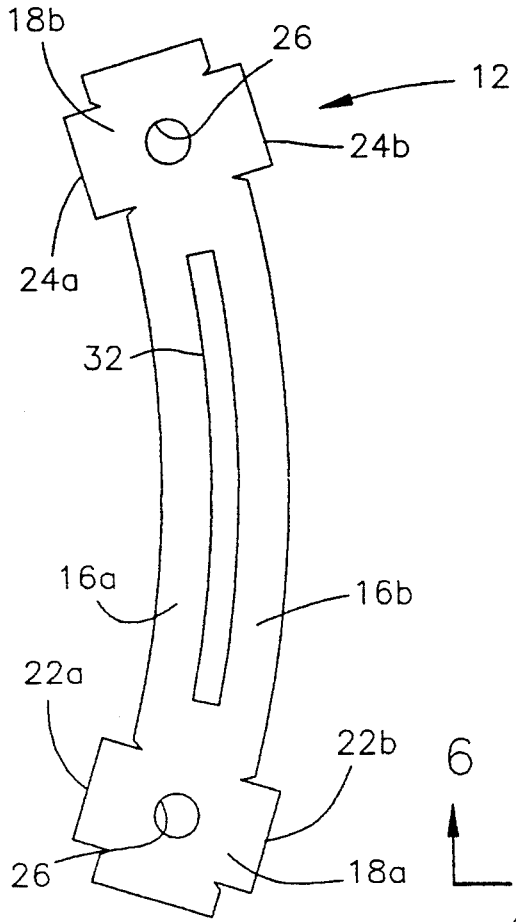
FIG. 4 is a plan view illustrating the main terminal after stamping but prior to bending.

In the preferred embodiment, both the main terminal 12 and the blade terminal 14 are formed from brass material which is approximately 0.057 inch thick, and more preferably SAE J461-CA 268 brass. After forming, each is immersed in or electroplated with tin or any other suitable material which will provide corrosion protection. In practice, tin deposited to thickness of at least about 0.0001 inch provides sufficient corrosion protection for automotive and marine applications. FIG. 4 shows the main terminal 12 after it has undergone the stamping operation and prior to forming into the shape shown in FIGS. 1 through 3. As can be seen, the main terminal 12 is preferably arcuately contoured in this condition so as to permit forming of the tubular portion without buckling or crimping the circumferential bands 16*a* and 16*b*. Moreover, the lateral flanges 18*a* and 18*b* generally follow this same arcuate contour such that the final bending operation is all that is needed to transform the main terminal 12 from the arcuate contour shown in FIG. 4 to the tubular form shown in FIGS. 1 through 3. During the bending operation, an aperture 26 punched in each of the lateral flanges 18*a* and 18*b* must be aligned with the other to form a composite aperture, as seen in FIGS. 1 and 2.

With particular reference to FIG. 3, it can be seen that the circumferential bands 16a and 16b are each substantially C-shaped, with a radial slot 30 formed therebetween. The slot 30 extends along the longitudinal length of the main terminal 12 and also extends between the lateral flanges 18a and 18b. The slot 30 is maintained at a predetermined width as a result of a shoulder 28 which extends from the lateral flange 18b. The shoulder 28 ensures that the slot 30 will be present unless the lateral flanges 18a and 18b are forcibly brought together under the influence of the fastener 48. Because the width of the slot 30 is limited, the extent to which the lateral flanges 18a and 18b and the circumferential bands 16a and 16b can be deflected is also limited, thereby reducing the possibility of plastic deformation.

Referring again to FIGS. 1 and 2, each of the lateral flanges 18a and 18b can be seen to include the aperture 26 for receiving the fastener 48. The apertures 26 are located midway between the shoulder 28 and the axial opening 20 such that the lateral flanges 18a and 18b are uniformly deflected toward each other when the fastener 48 is tightened to collapse the slot 30. As the slot 30 collapses, the circumferential bands 16a and 16b constrict, i.e., their interior diameters decrease, such that the circumferential bands 16a and 16b clamp the battery terminal post 34. Because the circumferential bands 16a and 16b are joined only adjacent the lateral flanges 18a and 18b, their clamping action is largely independent of the other. Moreover, when the fastener 48 is sufficiently tightened, the circumferential bands 16a and 16b extrude a small portion of the battery terminal post 34 through the circumferential slot 32 to form a protrusion 46 within the circumferential slot 32, as seen in FIG. 2. This protrusion 46 serves to secure the main terminal 12 on the battery terminal post 34 by preventing the lower circumferential band 16b from being inadvertently dislodged over the protrusion 46.

Figure 5:
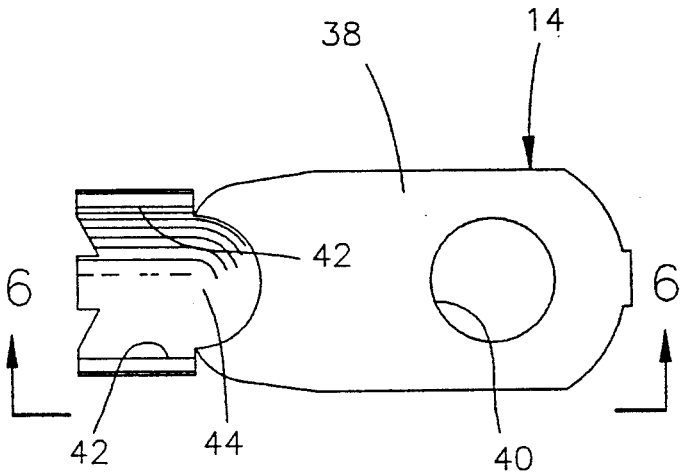
FIG. 5 is a side view of the blade terminal of the assembly of FIG. 1 in accordance with the preferred embodiment of this invention.
Figure 6:
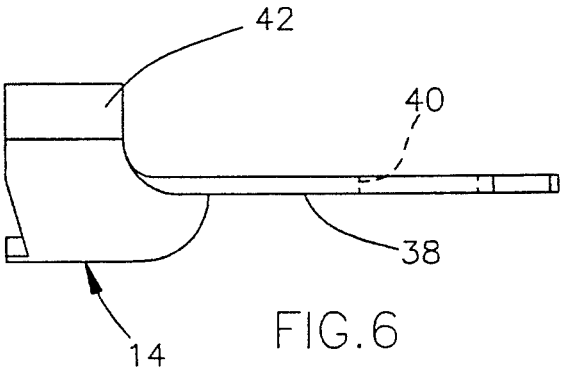
FIG. 6 is a plan view of the blade terminal of FIG. 5.

The blade terminal 14 is shown in detail in FIGS. 5 and 6. In the side view of FIG. 5, the blade terminal 14 is shown to include a blade portion 38 with an aperture 40 and a crimping portion 44 which includes a pair of crimping legs 42. During the stamping operations, the distance between the crimping legs 42 and the depth of the crimping portion 44 can readily be sized to accommodate electrical cables of various sizes. The aperture 40 is sized to correspond to the apertures 26 through the lateral flanges 18a and 18b in the main terminal 12. As previously noted, the width of the blade portion 38 is limited so as to nest between one of the pairs of flanges 22a, 22b and 24a, 24b. Though not illustrated, it can be readily understood that the blade terminal 14 is formed by a stamping operation from flat sheet metal stock, as was the main terminal 12.

The assembly of the blade terminal 14 to the main terminal 12 involves nesting the blade portion 38 of the blade terminal 14 between one of the pairs of flanges 22a, 22b and 24a, 24b, as shown in FIG. 1, such that the aperture 40 in the blade portion 38 is aligned with the apertures 26 in the lateral flanges 18a and 18b. The fastener 48 is then inserted through the apertures 26 and 40 and then slightly tightened enough to prevent the blade portion 38 from dropping out from between the flanges 22a, 22b or 24a, 24b.

Once the main terminal 12 has been placed over the battery terminal post 34, the fastener 48 is further tightened to draw the lateral flanges 18a and 18b together, thereby collapsing the slot 30 and constricting the circumferential bands 16a and 16b. As this occurs, the force generated by the circumferential bands 16a and 16b will be sufficient to slightly extrude the protrusion 46 through the circumferential slot 32, thereby retaining the lower circumferential band 16b below the protrusion 46. Tests conducted according to standard pull tests required by automobile manufacturers have indicated that the retention strength of the battery terminal connector assembly 10 is superior to that of the connectors of the prior art having a smoothly tapered axial opening.

To electrically disconnect the electrical cable from the battery 36, the fastener 48 can be simply removed from the apertures 26 and 40 and the blade terminal 14 uncoupled from the main terminal 12. If the battery 36 must be removed, the main terminal 12 can be easily expanded sufficiently such that the lower circumferential band 16b will pass over the protrusion 46 on the battery terminal post 34. Because the main terminal 12 is stamped from brass, it will tolerate greater flexing than would the die cast lead connectors of the prior art. Moreover, if the main terminal 12 is reattached to the battery terminal post 34, the protrusion 46 can easily be relocated between the circumferential bands 16a and 16b, such that additional deformation of the battery terminal post 34 is avoided.

From the above, it can be seen that a significant advantage of the battery terminal connector assembly 10 of the present invention is that the main terminal 12 is capable of securely and tightly retaining the battery terminal connector assembly 10 to the battery terminal post 34, while also providing the economic advantage of being formed by a stamping operation. As a result, the main terminal 12 can be readily mass produced at a lower cost than die cast connectors, and with less scrappage and waste. Because the main terminal 12 and the blade terminal 14 are formed separately, each can be sized independently to closely fit the battery terminal post 34 and the electrical cable or cables, respectively. Thus, as an additional advantage, the battery terminal connector assembly 10 of the present invention provides considerable flexibility in terms of being readily adaptable to specific applications without incurring excessive additional manufacturing costs.

In addition, because the blade terminal 14 is attached directly to the main terminal 12 with the fastener 48 used to generate the clamping load on the battery terminal post 34, the blade terminal 14 can be easily detached from the main terminal 12 to electrically disconnect the electrical cable from the battery terminal post 34 without needing to remove the main terminal 12 from the battery terminal post 34.

Another significant advantage of the present invention is that the fastener 48 causes a clamping action to be generated by both the upper and lower circumferential bands 16a and 16b. Because the upper and lower circumferential bands 16a and 16b are separated by a circumferential slot 32 and are joined only along a limited section of the main terminal 12, each produces an individual clamping force on the battery terminal post 34. Because the circumferential bands 16a and 16b are formed by a stamping operation from a higher strength material, such as the preferred brass instead of a die cast lead, the circumferential bands 16a and 16b can be made relatively thin and narrow while still possessing sufficient strength. Accordingly, the circumferential bands 16a and 16b can be flexed repeatedly without being significantly work hardened or plastically deformed.

In addition, the protrusion 46 formed on the battery terminal post 34 serves to retain the main terminal 12 on the battery terminal post 34. Specifically, the retention strength of the main terminal 12 is significantly increased such that the battery terminal connector assembly 10 can easily pass the most stringent pull tests required by automotive manufacturers. Yet, the main terminal 12 is structured to be readily and repeatedly expanded to release the battery terminal post 34 if necessary, such that the main terminal can be removed without damaging the battery terminal post 34.

In addition, the manufacturing and functional advantages of the battery terminal connector assembly 10 can be realized while also being highly resistant to excessive clamping loads generated by the fastener 48. The lateral flanges 18*a* and 18*b* and the blade portion 38 of the blade terminal 14 are flat and therefore readily withstand the high compressive forces necessary to securely retain the main terminal 12 on the battery terminal post 34. Because the main terminal 12 is formed independently of the blade terminal 14, the main terminal 12 can be sized to closely fit the battery terminal post 34. Consequently, the radial slot 30 can have a limited width while still permitting sufficient deflection to secure the main terminal 12 to the battery terminal post 34, practically eliminating the potential for plastic deformation, overstressing and work hardening of the main terminal 12 and the circumferential bands 16*a* and 16*b*. Additionally, in that the blade terminal 14 and the main terminal 12 are formed by separate stamping operations, the battery terminal connector assembly 10 has the advantage of being readily mass-produced in various sizes and later matched to properly mate with assorted sizes of electrical cables and battery terminal posts 34.

Accordingly, the present invention provides a battery terminal connector which is capable of reliably maintaining an electrical cable or harness in electrical contact with a battery, while having the added benefit of being an economical two-piece construction whose individual members are formed by separate stamping operations. The two-piece construction permits one member to be dedicated to securely clamping the battery terminal post while the second member is dedicated to securely crimping the electrical cable or cables. The battery terminal connector includes two separate circumferential bands, each of which circumscribes and clamps the battery terminal post. The circumferential bands define a circumferential slot therebetween which slightly extrudes the battery terminal post to increase the retention capability of the battery terminal connector.

While the invention has been described in terms of a preferred embodiment, it is apparent that other forms could be adopted by one skilled in the art. Accordingly, the scope of the invention is to be limited only by the following claims.

What is claimed is:

1. An electrical connector for a battery post comprising:

a main terminal having one end, an opposite end and a frustoconical gripping portion interposed said one end and said opposite end, said frustoconical gripping portion having a substantially annular shape so as to define an axial opening therethrough, said axial opening having a central axis, said frustoconical gripping portion of said main terminal having a circumferentially extending slot; and means for constricting said frustoconical gripping portion about said battery post, said constricting means being operable to cause a clamping action by said frustoconical gripping portion about said battery post;

whereby as said constricting means constricts said frustoconical gripping portion said circumferentially extending slot enables said frustoconical gripping portion to generate a clamping force.

2. The electrical connector of claim 1 wherein said circumferentially extending slot in said frustoconical gripping portion further defines a pair of circumferential strap members such that as said constricting means constricts said frustoconical gripping portion each of said circumferential strap members generates an individual clamping force.

3. The electrical connector of claim 2 wherein said axial opening has a substantially frustoconical shape such that one of said pair of circumferential strap members has a smaller internal diameter than the other of said pair of circumferential strap members.

4. The electrical connector of claim 1 wherein said one end of said main terminal comprises a first flange extending in a direction away from said frustoconical gripping portion; and wherein said opposite end of said main terminal comprises a second flange extending in a direction away from said frustoconical gripping portion, said first and second flanges being adjacent each other.

5. The electrical connector of claim 4 wherein said first and second flanges extend from said frustoconical gripping portion in a predetermined spaced-apart relation so as to define a longitudinal slot therebetween.

6. The electrical connector of claim 5 wherein said means for constricting comprises:

an aperture through each said first and second flanges; and fastener means disposed in each of said apertures;

whereby said fastener means is operable to draw said first and second flanges together so as to collapse said longitudinal slot and thereby constrict said frustoconical gripping portion.

7. The battery terminal of claim 5 further comprising a blade member attached to at least one of said first and second flanges.

8. The electrical connector of claim 1 wherein said one end of said main terminal further comprises a first flange having a substantially planar surface and further wherein said opposite end of said main terminal comprises a second flange having a substantially planar surface, each of said first and second flanges being adjacent to each other and extending in a direction away from said central axis of said axial opening of said frustoconical gripping portion.

9. The electrical connector of claim 8 wherein said means for constricting comprises:

an aperture through each said first and second flanges; and fastener means disposed in each of said apertures;

whereby said fastener means is operable to draw said first and second flanges together so as to collapse said longitudinal slot and thereby constrict said frustoconical gripping portion.

10. An electrical connector for attaching to a battery post, said electrical connector comprising:

a main terminal having a frustoconical gripping portion of substantially annular shape so as to define an axial opening therethrough, said frustoconical gripping portion having an upper circumferential strap portion and a lower circumferential strap portion defining a circumferentially extending slot therebetween, said main terminal further having a first flange portion at one end and a second flange portion at an opposite end, said first and second flange portions extending in a direction away from said axial opening in spaced relation so as to form a longitudinal slot therebetween, each one of said first and second flange portions joining said upper and lower circumferential strap portions;

and means for constricting, associated with said first and second flange portions for constricting said upper and lower circumferential strap portions, said means for constricting being operable to cause a clamping action to be generated by said upper and lower circumferential strap portions about said battery post;

whereby said circumferentially extending slot enables each of said upper and lower circumferential strap portions to generate an individual clamping force upon said battery post.

11. The battery terminal of claim 10 wherein said axial opening has a substantially frustoconical shape such that said upper circumferential strap portion has a smaller internal diameter than said lower circumferential strap portion.

12. The battery terminal of claim 10 further comprising a blade member attached to at least one of said first and second flange portions.

13. The battery terminal of claim 10 wherein said individual clamping forces are directed in a radially inward direction relative to said axial opening.

14. The battery terminal of claim 10 further comprising means for establishing a predetermined width of said longitudinal slot between said first and second flange portions.

15. The battery terminal of claim 10 further comprising a shoulder extending from one of said first and second flange portions, said shoulder abutting a second of said first and second flange portions so as to define a predetermined width of said longitudinal slot.

16. The battery terminal of claim 10 wherein said constricting means comprises:

an aperture through each said first and second flange portions; and fastener means disposed in said aperture in each said first and second flange portions;

whereby said fastener means is operable to draw said first and second flange portions together so as to collapse said longitudinal slot and thereby constrict each said upper and lower circumferential strap portions.

17. The battery terminal of claim 16 further comprising a blade member, said blade member being attached to one of said first and second flange portions with said fastener means.

18. A battery terminal connector assembly for attaching to a battery post, said battery terminal connector assembly comprising:

a frustoconical annular member having an axial opening therethrough, said frustoconical annular member having an upper circumferential strap portion and a lower circumferential strap portion so as to define a circumferentially extending slot therebetween, said axial opening having a substantially frustoconical shape such that said upper circumferential strap portion has a smaller internal diameter than said lower circumferential strap portion, said frustoconical annular member further having one end defining a first flange and an opposite end defining a second flange so as to form a pair of opposing flanges forming a longitudinal slot therebetween, one end of each said pair of opposing flanges joining said upper and lower circumferential strap portions;

said first and second flanges extending substantially parallel relative to each other in spaced-apart relation such that said longitudinal slot extends therebetween;

means for constricting said frustoconical annular member, said constricting means being associated with said first and second flanges for constricting said upper and lower circumferential strap portions, said means for constricting being operable to cause radially inward clamping forces to be generated by both said upper and lower circumferential strap portions about said battery post; and a blade member attached to at least one of said first and second flanges;

whereby said circumferentially extending slot enables each said lower and upper circumferential strap portions to generate an individual radially inward clamping force upon said battery post.

19. The battery terminal connector assembly of claim 18 wherein said means for constricting comprises:

an aperture through each said first and second flanges; and fastener means disposed in said aperture in each said first and second flanges;

whereby said fastener means is operable to draw said first and second flanges together so as to collapse said longitudinal slot and thereby constrict each said upper and lower circumferential strap portions.

20. The battery terminal connector assembly of claim 18 further comprising means for defining a predetermined width of said longitudinal slot.

21. The battery terminal connector assembly of claim 18 wherein said means for constricting comprises a shoulder extending from one of said first and second flanges, said shoulder abutting a second of said flanges so as to define a predetermined width of said longitudinal slot.

* * * * *